US012523112B2

(12) United States Patent
Banuta et al.

(10) Patent No.: US 12,523,112 B2
(45) Date of Patent: Jan. 13, 2026

(54) MONITORING OPERATION OF A ROTATING CONTROL DEVICE

(71) Applicant: WEATHERFORD TECHNOLOGY HOLDINGS, LLC, Houston, TX (US)

(72) Inventors: Levi C. Banuta, Houston, TX (US); Thomas H. Koithan, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/897,324

(22) Filed: Sep. 26, 2024

(65) Prior Publication Data

US 2025/0075583 A1 Mar. 6, 2025

Related U.S. Application Data

(62) Division of application No. 18/466,995, filed on Sep. 14, 2023, now Pat. No. 12,286,859.

(60) Provisional application No. 63/580,202, filed on Sep. 1, 2023.

(51) Int. Cl.
*E21B 33/08* (2006.01)
*E21B 47/06* (2012.01)

(52) U.S. Cl.
CPC ..... *E21B 33/085* (2013.01); *E21B 47/06* (2013.01)

(58) Field of Classification Search
CPC ..... E21B 47/024; E21B 44/005; E21B 47/06; E21B 47/12; E21B 47/00; E21B 47/022; E21B 47/13; E21B 33/085; E21B 44/00
See application file for complete search history.

(56) References Cited

U.S. PATENT DOCUMENTS

| | | | |
|---|---|---|---|
| 7,588,082 | B2 | 9/2009 | Lasater |
| 8,122,975 | B2 | 2/2012 | Belcher et al. |
| 8,322,462 | B2 | 12/2012 | Kuckes |

(Continued)

FOREIGN PATENT DOCUMENTS

| | | | |
|---|---|---|---|
| GB | 2135060 | B | 6/1986 |
| WO | 2012098980 | A1 | 7/2012 |
| WO | 2014099965 | A2 | 6/2014 |

OTHER PUBLICATIONS

Wikipedia, "Near-field magnetic induction communication," 2 pages, downloaded on Jun. 24, 2023.

(Continued)

*Primary Examiner* — Zakiya W Bates
(74) *Attorney, Agent, or Firm* — Smith IP Services, P.C.

(57) ABSTRACT

A pressure control assembly can include an outer housing and a rotating control device including a bearing assembly with a rotatable inner barrel, a pressure sensor and one or more magnetic field generators, and at least two seal elements configured to seal between the inner barrel and a tubular positioned in the pressure control assembly. A magnetic field detector secured to the outer housing is configured to receive signals from the magnetic field generators, the signals being indicative of outputs of the pressure sensor. A method can include securing a magnetic field detector to an outer housing, installing the rotating control device in the outer housing, the rotating control device comprising a rotatable inner barrel, a pressure sensor and multiple magnetic field generators, and transmitting signals indicative of outputs of the pressure sensor from the magnetic field generators to the magnetic field detector.

7 Claims, 7 Drawing Sheets

(56) References Cited

U.S. PATENT DOCUMENTS

| | | | | |
|---|---|---|---|---|
| 9,845,653 | B2 | 12/2017 | Hannegan et al. | |
| 10,081,985 | B2 | 9/2018 | Bullock | |
| 10,738,587 | B2 | 8/2020 | Sehsah et al. | |
| 10,781,657 | B2 | 9/2020 | Hardt et al. | |
| 10,781,660 | B2 | 9/2020 | Arsalan et al. | |
| 11,187,056 | B1 | 11/2021 | Tenorio et al. | |
| 2012/0234558 | A1* | 9/2012 | Godfrey ..... | E21B 47/138 166/66.6 |

OTHER PUBLICATIONS

US Office Action issued Jul. 24, 2024 for U.S. Appl. No. 18/466,995, 11 pages.

* cited by examiner

MONITORING OPERATION OF A ROTATING CONTROL DEVICE

CROSS-REFERENCE TO RELATED APPLICATIONS

This application is a division of prior application Ser. No. 18/466,995 filed on 14 Sep. 2023, which claims the benefit of the filing date of provisional application No. 63/580,202 filed on 1 Sep. 2023. The entire disclosures of these prior applications are incorporated herein by this reference.

BACKGROUND

This disclosure relates generally to equipment utilized and operations performed in conjunction with, for example, an offshore well and, in examples described below, more particularly provides for monitoring the operation of a rotating control device.

A rotating control device is an item of equipment typically used in well drilling operations. The rotating control device contains and diverts the annular fluids of the well near the surface, while also allowing a tubular string (such as, a drill string) to rotate in the well. This sealing off of the annulus can provide a number of benefits, including enabling precise control of a pressure in the annulus, and control of the flow of fluids from the annulus to the surface.

It will, therefore, be readily appreciated that improvements are continually needed in the art of monitoring operation of rotating control devices. The present specification provides such improvements to the art, which can be used in a variety of different well operations.

DETAILED DESCRIPTION

Figure 1:
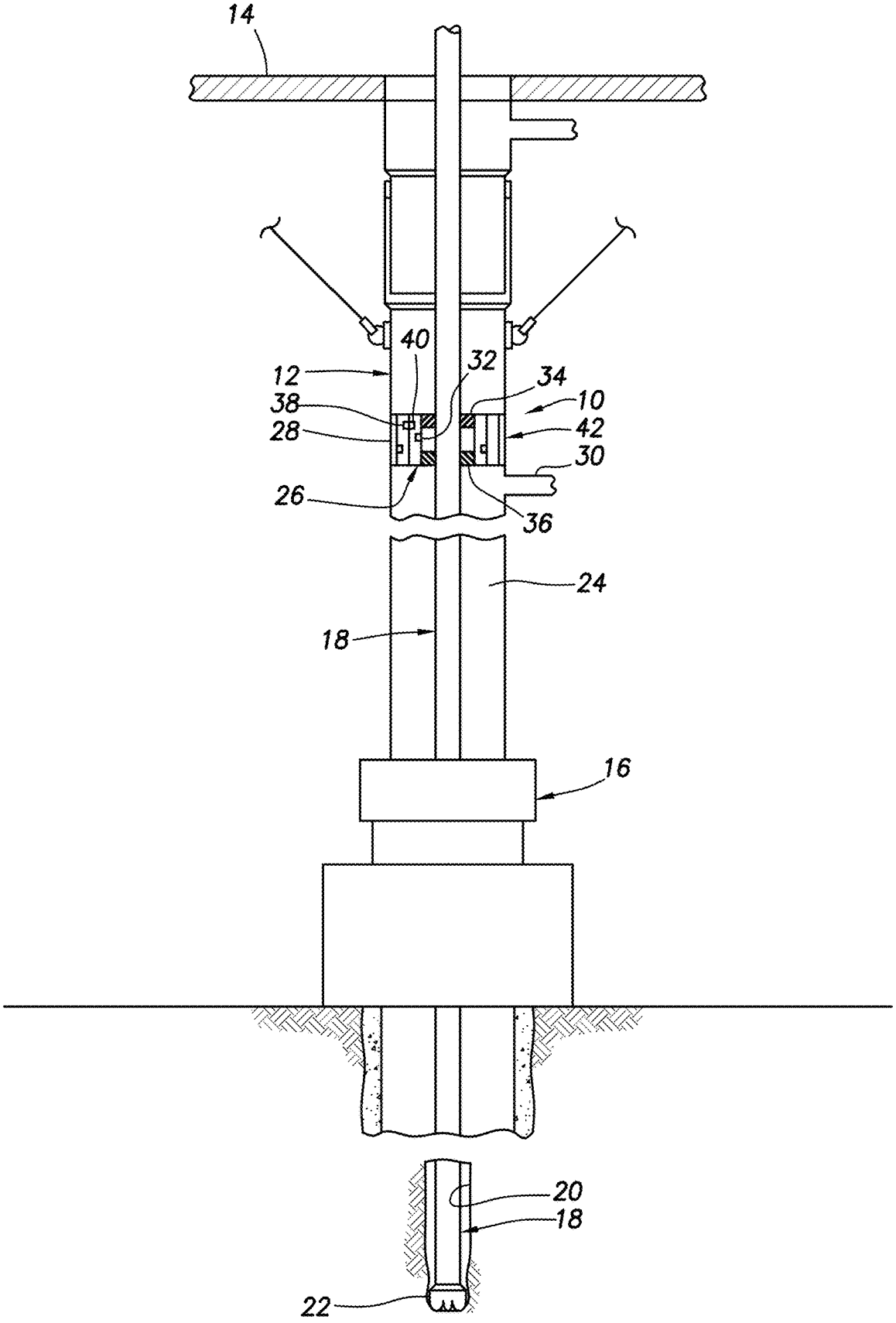
FIG. 1 is a representative partially cross-sectional view of an example of a well system and associated method which can embody principles of this disclosure.

The present disclosure, including the following detailed description and the accompanying FIGS. 1-7B, provides to the art a pressure control assembly 42 for use with a subterranean well. In one example, the pressure control assembly 42 can comprise an outer housing 28, and a rotating control device 26 releasably secured in the outer housing 28. The rotating control device 26 can comprise a bearing assembly 54 including a rotatable inner barrel 58, a pressure sensor 32 and one or more magnetic field generators 40; and at least two seal elements 34, 36 configured to seal between the inner barrel 58 and a tubular 18*a* positioned in the pressure control assembly 42. A magnetic field detector 38 secured to the outer housing 28 is configured to receive signals 74 from the one or more magnetic field generators 40, the signals 74 being indicative of outputs of the pressure sensor 32.

The pressure sensor 32 may be in fluid communication with an interior of the inner barrel 58. The pressure sensor 32 may be in fluid communication with the interior of the inner barrel 58 longitudinally between the seal elements 34, 36.

The outer housing 28 may be configured for connection in a riser string 12.

The "one or more" magnetic field generators 40 may comprise multiple magnetic field generators 40, and the multiple magnetic field generators 40 may be arranged to rotate with the inner barrel 58. The magnetic field generators 40 may be unevenly spaced about a circumference of the inner barrel 58.

The bearing assembly 54 may also include an accelerometer 72. The signals 74 may be further indicative of outputs of the accelerometer 72.

The present disclosure also provides to the art a method of monitoring operation of a rotating control device 26. In one example, the method can comprise: securing a magnetic field detector 38 to an outer housing 28 configured to releasably receive the rotating control device 26 therein; installing the rotating control device 26 in the outer housing 28, the rotating control device 26 comprising a rotatable inner barrel 58, a pressure sensor 32 and multiple magnetic field generators 40; and transmitting signals 74 indicative of outputs of the pressure sensor 32 from the magnetic field generators 40 to the magnetic field detector 38.

The method may include rotating the magnetic field generators 40 with the inner barrel 58 relative to the outer housing 28. The transmitting step may include activating a selected portion of the magnetic field generators 40, the selected portion being indicative of the outputs of the pressure sensor 32.

The selected portion of the magnetic field generators 40 may form a pattern of magnetic fields detected by the magnetic field detector 38, the pattern of magnetic fields comprising the signals 74. The pattern may comprise a binary pattern, and the magnetic fields may correspond to bits of the binary pattern. The pattern of magnet fields may correspond to a spacing of the magnetic field generators 40 on the inner barrel 58.

The rotating control device 26 may include an accelerometer 72. The transmitting step may include transmitting signals 74 indicative of outputs of the accelerometer 72 from the magnetic field generators 40 to the magnetic field detector 38.

Also described herein and depicted in the drawings is a system 10 for use with a subterranean well. In one example, the system 10 comprises an outer housing 28 configured to connect in a riser string 12, a magnetic field detector 38 secured to the outer housing 28, and a rotating control device 26 configured to be releasably secured in the outer housing 28. The rotating control device 26 can comprise at least two seal elements 34, 36 arranged to seal against a tubular 18*a* positioned in a central bore 44 of the rotating control device 26, a pressure sensor 32 in fluid communication with the central bore 44, and multiple magnetic field generators 40. The seal elements 34, 36, the pressure sensor 32 and the magnetic field generators 40 are rotatable with the tubular 18*a* relative to the outer housing 28.

The magnetic field generators 40 may be configured to transmit signals 74 indicative of outputs of the pressure sensor 32 to the magnetic field detector 38. The pressure sensor 32 may be in fluid communication with the central bore 44 longitudinally between the seal elements 34, 36.

The rotating control device 26 may further comprise a bearing assembly 54 including a rotatable inner barrel 58. The magnetic field generators 40 may be arranged to rotate with the inner barrel 58.

The magnetic field generators 40 may be unevenly spaced about a circumference of the inner barrel 58. The bearing assembly 54 may further include an accelerometer 72 arranged to rotate with the inner barrel 58.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a riser string 12 extends between a water-based rig 14 and a subsea facility 16. The subsea facility 16 may comprise a wellhead, a lower marine riser package, an annular blowout preventer, and/or other suitable components.

However, note that the scope of this disclosure is not limited to a water-based rig, a riser string or a subsea facility. Instead, the principles of this disclosure can be practiced with a land-based rig, in which case a riser string and a subsea facility are not used.

As depicted in FIG. 1, a tubular string 18 extends through the riser string 12. In this example, the tubular string 18 is a drill string used to drill a wellbore 20. A drill bit 22 is connected at a distal end of the drill string. The tubular string 18 may comprise a continuous tubing or pipe, or the tubular string may be made up of connected-together joints. In other examples, other types of tubular strings and other types of tubulars may be used.

An annulus 24 is formed radially between the riser string 12 and the tubular string 18. A rotating control device 26 seals off the annulus 24 between the riser string 12 and the tubular string 18, while still allowing the tubular string 18 to rotate in the riser string 12.

The rotating control device 26 is releasably secured in an outer housing 28 that is connected as part of the riser string 12. A lateral outlet 30 allows circulation of drilling mud and/or other fluids between the annulus 24 below the rotating control device 26 and, for example, surface fluid conditioning equipment (such as, a shaker, a de-gasser, fluid density modifier, etc.).

The rotating control device 26 and outer housing 28 are components of a pressure control assembly 42, of the type sometimes referred to by those skilled in the art as a pressure control head, a rotating diverter or a rotating annular preventer. The pressure control assembly 42 in the FIG. 1 example is used to seal off the annulus 24 and permit rotation of the tubular string 18 in the riser string 12.

In the FIG. 1 example, the rotating control device 26 includes a pressure sensor 32 for sensing pressure between seal elements 34, 36 that seal against the tubular string 18. A magnetic field detector 38 and multiple magnetic field generators 40 are used to communicate signals indicative of outputs of the pressure sensor 32. In this manner, operation of the rotating control device 26 (for example, whether the seal elements 34, 36 require maintenance) can be monitored at a remote location (such as, the surface, the rig 14, etc.).

In other examples described more fully below, the rotating control device 26 can include an accelerometer for monitoring a rotational speed of the seal elements 34, 36, bearing assembly 58 and associated components. Alternatively, frequency of the received signals can be used to determine the rotational speed.

Figure 2:
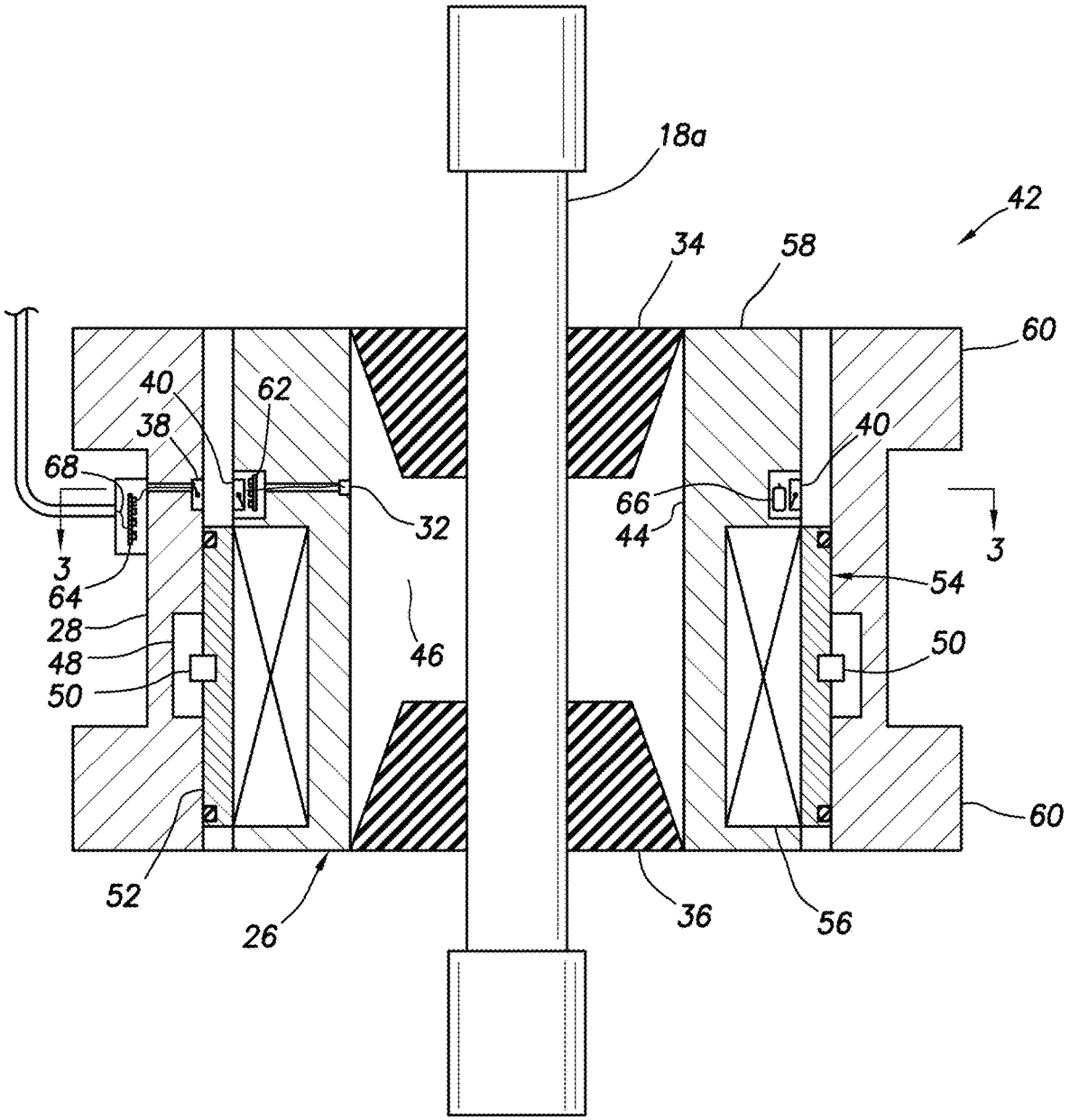
FIG. 2 is a representative partially cross-sectional view of an example of a pressure control assembly that may be used in the FIG. 1 well system and method.

Referring additionally now to FIG. 2, a partially cross-sectional view of an example of the pressure control assembly 42 is representatively illustrated. For convenience, the FIG. 2 pressure control assembly 42 is described below as it may be used in the system 10 and method of FIG. 1, but it should be clearly understood that the FIG. 2 pressure control assembly can be used with other systems and methods in keeping with the scope of this disclosure.

In the FIG. 2 example, a tubular 18*a* of the tubular string 18 is positioned in a central bore 44 of the pressure control device 26. The seal elements 34, 36 sealingly engage an outer surface of the tubular 18*a* and thereby seal off an annulus 46 formed radially between the tubular and the central bore 44.

The pressure control device 26 is releasably secured in the outer housing 28 using a latch assembly 48. Collets or latch dogs 50 of the latch assembly 48 engage an outer barrel 52 of a bearing assembly 54. Bearings 56 allow an inner barrel 58 of the bearing assembly 54 to rotate relative to the outer barrel 52.

The seal elements 34, 36 are secured to the inner barrel 58. Thus, the tubular 18*a*, the seal elements 34, 36 and the inner barrel 58 can rotate together relative to the outer barrel 52 and the outer housing 28.

The outer housing 28 is configured to connect in the riser string 12. For example, flanges 60 may be provided at opposite ends of the outer housing 28. In other examples, the flanges 60 could be configured to connect the outer housing 28 to a land-based wellhead.

The magnetic field detector 38 is positioned in the outer housing 28 so that it can detect magnetic fields produced by the magnetic field generators 40 on the inner barrel 58. The magnetic field generators 40 are spaced apart along a circumference of the inner barrel 58.

Thus, as the inner barrel 58 rotates, each of the generators 40 passes by the detector 38 in succession. When a generator 40 is in close enough proximity to the detector 38, a magnetic field produced by the generator can be detected by the detector.

The detector 38 may be any device capable of detecting a magnetic field produced by a generator 40. Examples of suitable detectors include (but are not limited to) Hall effect sensors and reed switches. The generators 40 may be any devices capable of producing a magnetic field. Examples of suitable generators include (but are not limited to) coils, solenoids, electromagnets and magnetostrictive devices.

The pressure sensor 32 is in fluid communication with the annulus 46 between the seal elements 34, 36. Outputs of the pressure sensor 32 are communicated to an electronics package 62 in the outer barrel 58. The electronics package 62 is connected to and controls activation of the generators 40, so that they transmit signals indicative of the outputs of the pressure sensor 32. For example, the electronics package 62 can selectively activate a selected portion of the generators 40 as they pass by the detector 38, so that a binary pattern formed by activated and inactive generators is detected by the detector. The binary pattern or digital signal is, thus, indicative of the output of the pressure sensor 32.

The detector 38 is connected to another electronics package 64 secured on the outer housing 28. The electronics package 64 communicates to a remote location the signals detected by the detector 38. In the FIG. 1 example, an operator on the rig 14 or at another remote location can be advised of the pressure measurements taken by the pressure sensor 32, thereby providing for remote monitoring of the conditions of the seal elements 34, 36.

As depicted in FIG. 2, each of the electronics packages 62, 64 comprises a printed circuit board with suitable electronic components, such as, integrated circuits, processors, permanent and volatile memory, batteries, etc. The memory of the electronics package 62 may store instructions for digitizing the outputs of the pressure sensor 32 and producing a corresponding pattern of activating the generators 40 to thereby transmit signals indicative of the pressure sensor outputs. The memory of the electronics package 64 may store instructions for buffering/storing the received signals and transmitting to the surface or a remote location. The scope of this disclosure is not limited to any particular components used in the electronics packages 62, 64.

In the FIG. 2 example, the pressure sensor 32, generators 40 and electronics package 62 are supplied electrical power from a battery 66. The battery 66 may be connected directly to the electronics package 62. In other examples, a generator could be used to produce electrical power for the pressure sensor 32, generators 40 and electronics package 62.

In the FIG. 2 example, the detector 38 and electronics package 64 are supplied electrical power from the surface via a line 68. In other examples, the electronics package 64 could communicate wirelessly with a remote location, in which case a battery or a generator could be used to provide electrical power.

Figure 3:
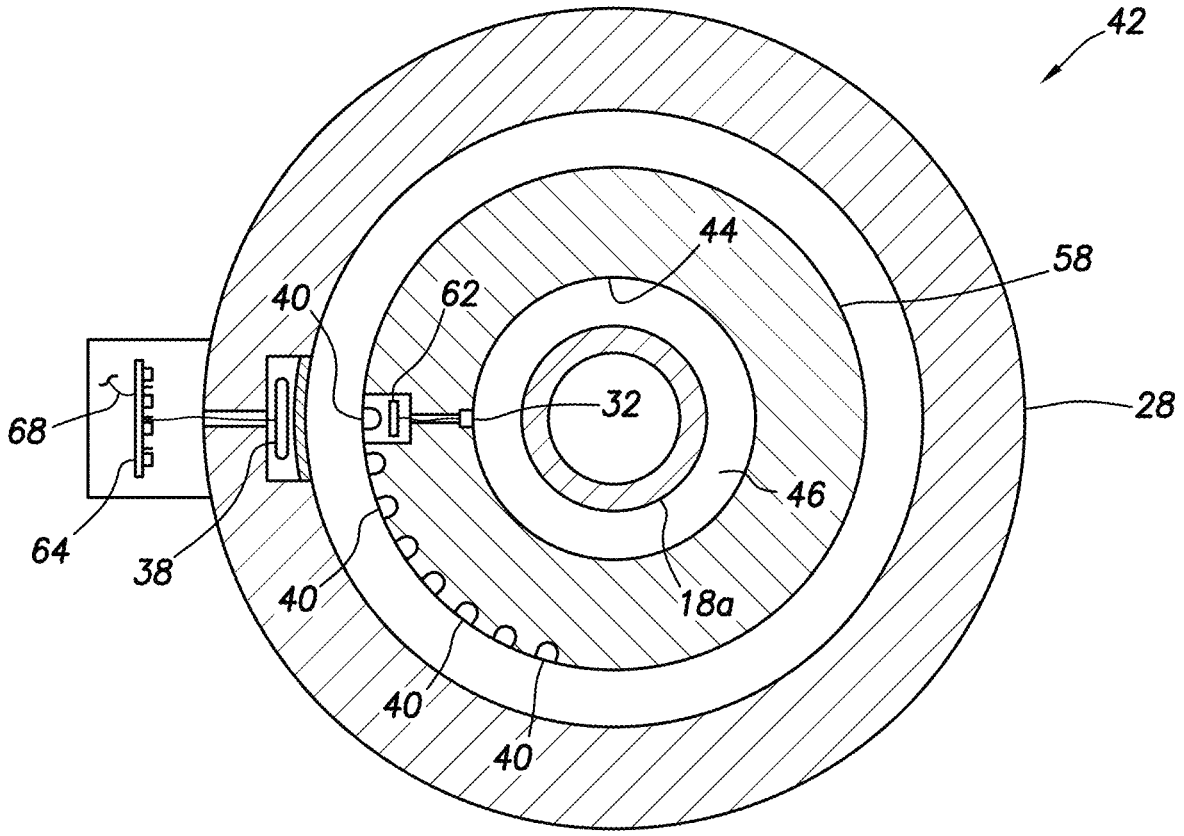
FIG. 3 is a representative cross-sectional view of the FIG. 2 pressure control assembly, taken along line 3-3 of FIG. 2.

Referring additionally now to FIG. 3, a cross-sectional view of the pressure control assembly 42, taken along line 3-3 of FIG. 2, is representatively illustrated. However, the FIG. 3 example differs somewhat from the FIG. 2 example.

In the FIG. 3 example, the generators 40 are not spaced evenly along a circumference of the inner barrel 58. Instead, eight of the generators 40 are equally spaced apart along only a portion of the circumference. In other examples, the generators may be spaced differently.

In the FIG. 3 example, a separate battery 66 is not used. Instead, the battery is incorporated into the electronics package 62.

As depicted in FIG. 3, one of the generators 40 is directly opposite the detector 38 and is in sufficiently close proximity to produce a magnetic field that can be detected by the detector 38. As the inner barrel 58 rotates clockwise as viewed in FIG. 3, each of the generators 40 in succession will be positioned opposite the detector 38 and will be in sufficiently close proximity to produce a magnetic field that can be detected by the detector.

Since, in the FIG. 3 example, there are eight of the generators 40, there is the possibility that eight magnetic field detection events will occur for each rotation of the inner barrel 58. As described more fully below (and depicted in FIGS. 7A & B), the generators 40 may or may not produce a magnetic field as each generator passes by the detector 38, so the presence, absence or strength of the magnetic field can be used to represent respective "1" or "0" value bits of a binary pattern. In some examples, a magnetic field of higher amplitude can be interpreted as a "1" value bit and a lower amplitude of the field can be interpreted as a "0" value bit.

Figure 4:
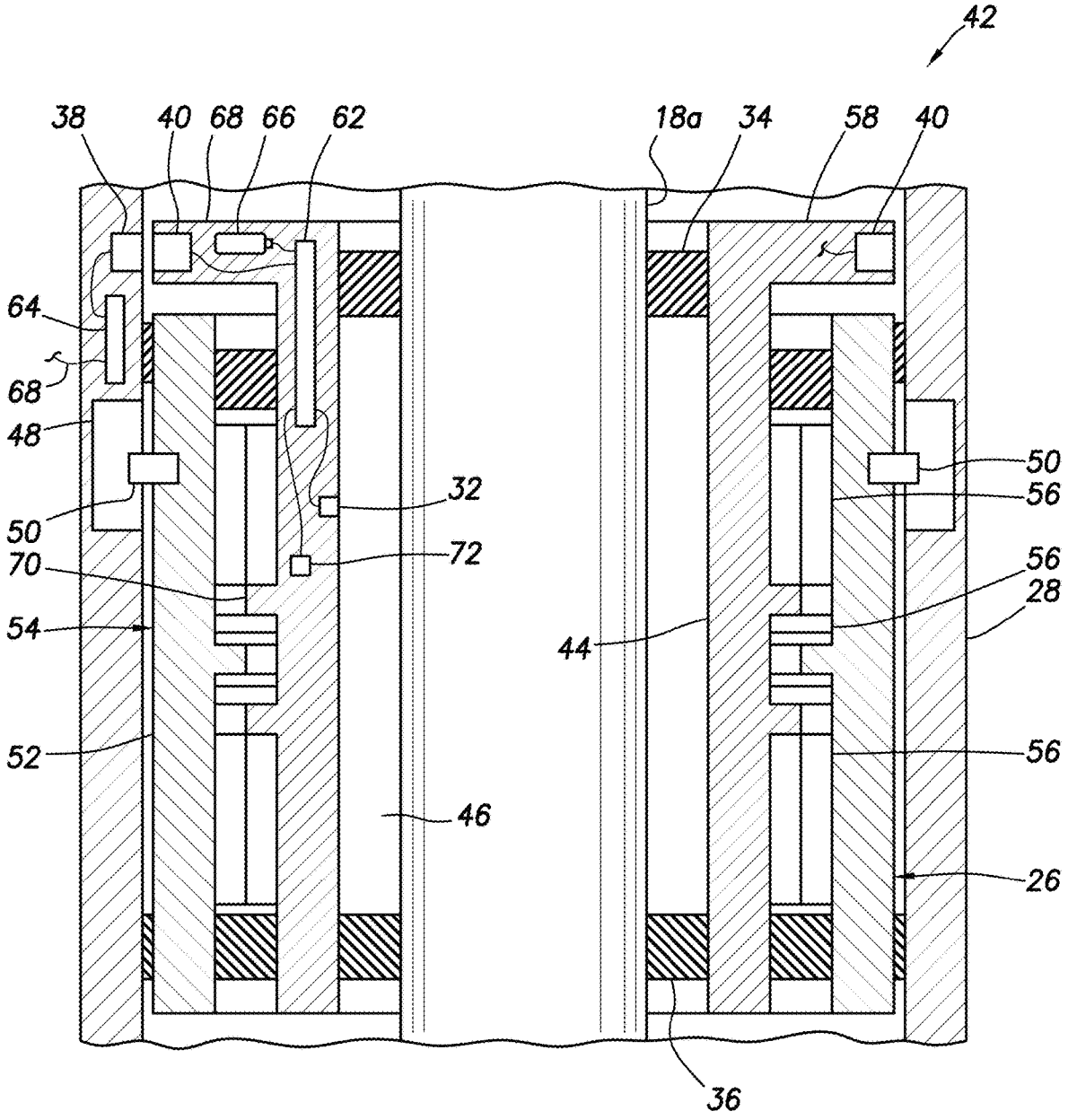
FIG. 4 is a representative partially cross-sectional view of another example of the pressure control assembly.

Referring additionally now to FIG. 4, a partially cross-sectional view of another example of the pressure control assembly 42 is representatively illustrated. The FIG. 4 example is similar in many respects to the FIGS. 2 & 3 examples, so the same reference numerals are used in FIG. 4 to indicate similar elements.

In the FIG. 4 example, the generators 40 are mounted on a radially outwardly extending flanged shaped portion 68 of the inner barrel 58. Although the inner barrel 58 is depicted in the figures as being a single component, the inner barrel may in some examples be made up of multiple components. For example, the portion 68 may be separately formed from another portion 70 configured to support the bearings 56. Similarly, the outer barrel 52 may comprise multiple components.

In the FIG. 4 example, each of the pressure sensor 32, the generators 40 and the battery 66 are connected to the electronics package 62. In addition, another sensor (an accelerometer 72) is connected to the electronics package 62. The accelerometer 72 is used to determine a rotational speed or angular velocity of the inner barrel 58 and seal elements 34, 36. In some examples, the accelerometer 72 can be mounted directly on the printed circuit board of the electronics package 62.

The electronics package 62 memory can include instructions for digitizing the outputs of the accelerometer 72 and producing a corresponding pattern of activating the generators 40 to thereby transmit signals indicative of the accelerometer outputs. The signals indicative of the accelerometer 72 outputs can be transmitted alternately with the signals indicative of the pressure sensor 32 outputs, or in another suitable pattern or sequence.

Figure 5:
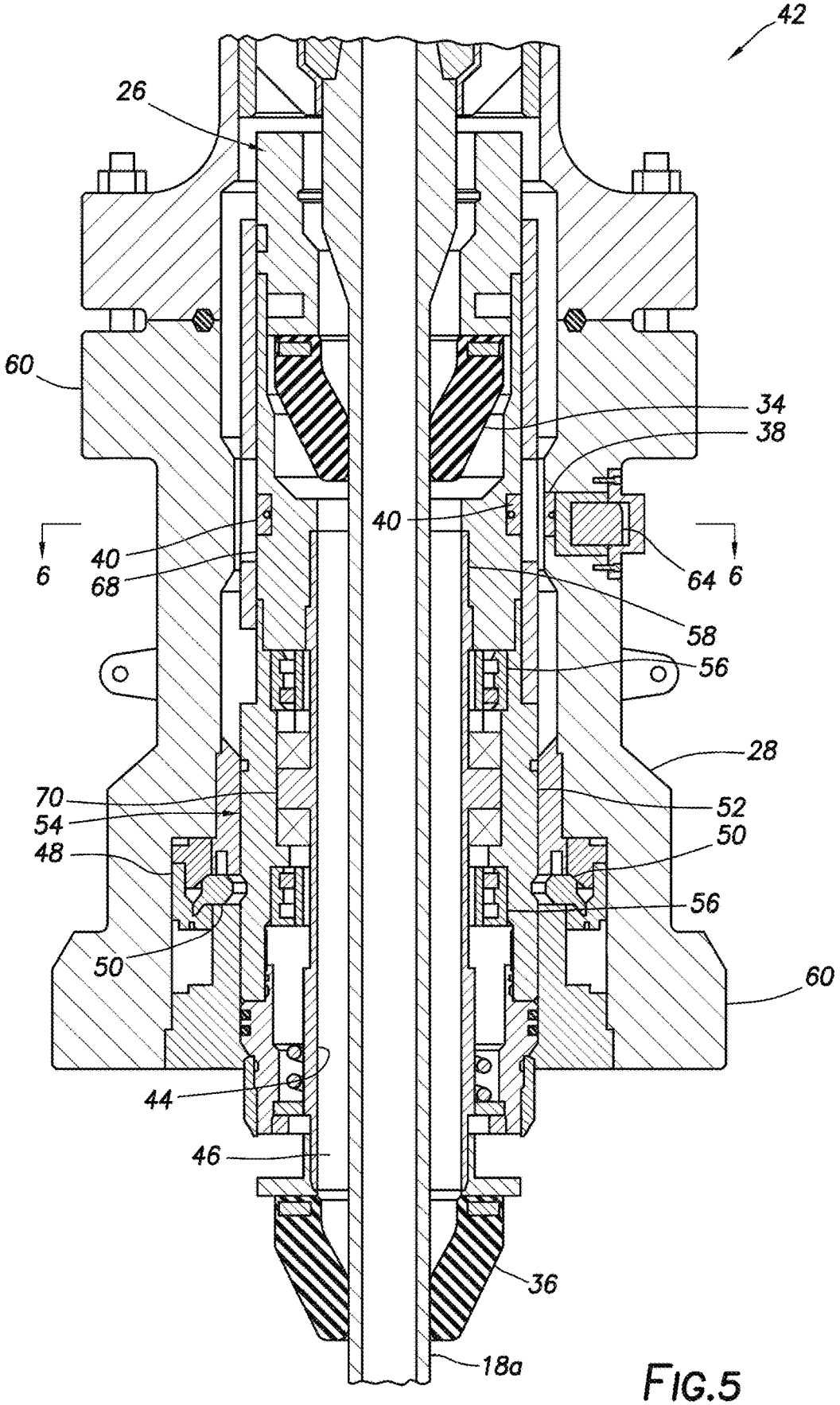
FIG. 5 is a representative cross-sectional view of another example of the pressure control assembly.

Referring additionally now to FIG. 5, another example of the pressure control assembly 42 is representatively illustrated. The FIG. 5 example is similar in many respects to the FIGS. 2-4 examples, so the same reference numerals are used in FIG. 5 to indicate similar elements.

In the FIG. 5 example, the outer housing 28 is configured to be connected in a riser string (such as the FIG. 1 riser string 12). The latch assembly 48 is released, thereby allowing the rotating control device 26 to be retrieved from the outer housing 28, for example, to perform maintenance. The pressure sensor 32 (not shown in FIG. 5) and the magnetic induction communication system incorporated into the pressure control assembly 42 permit an operator to know whether and how much pressure may be trapped in the annulus 46 between the seal elements 34, 36 when the rotating control device 26 is retrieved.

Figure 6:
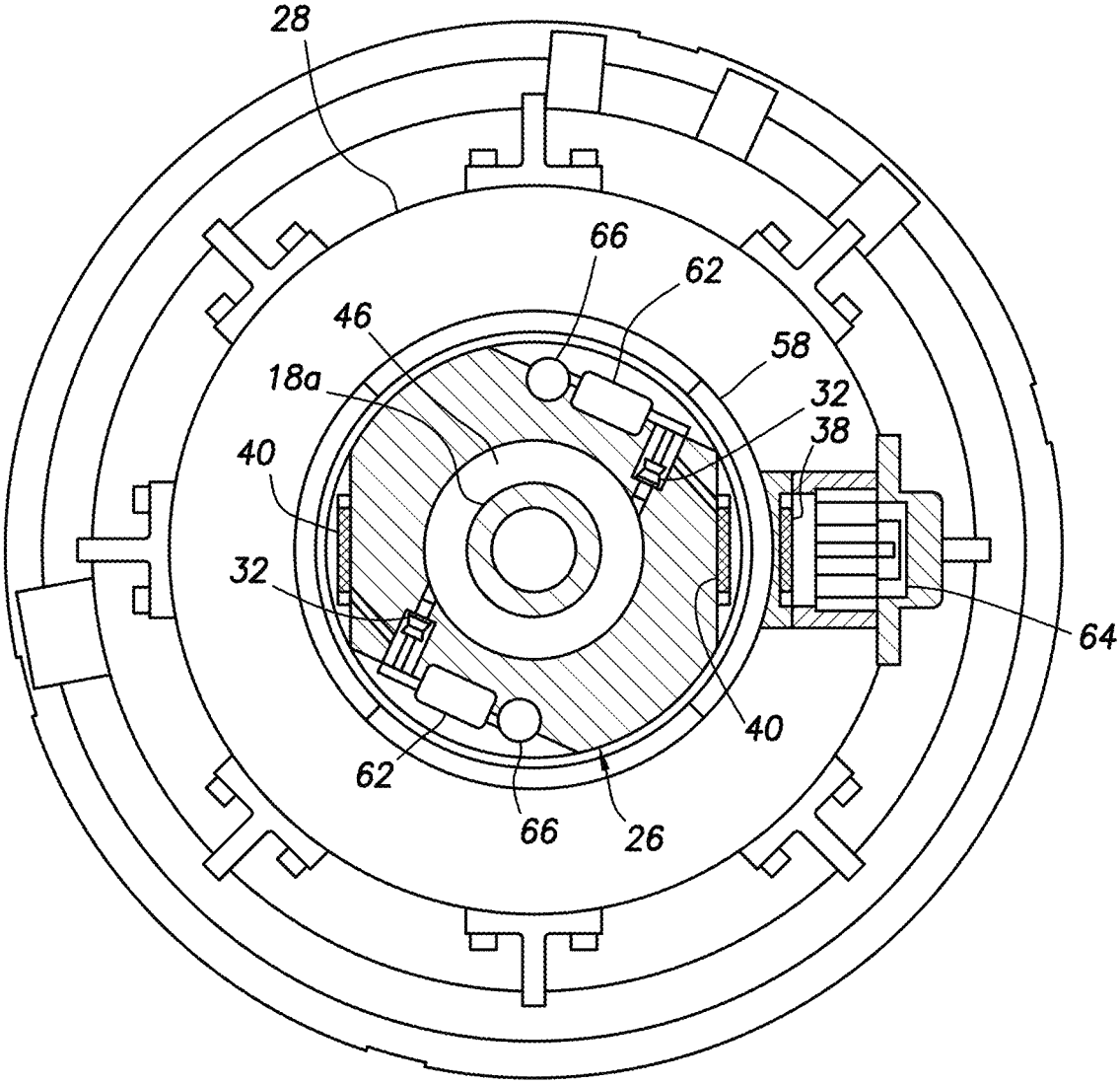
FIG. 6 is a representative cross-sectional view of the FIG. 5 pressure control assembly, taken along line 6-6 of FIG. 5.

Referring additionally now to FIG. 6, a cross-sectional view of the FIG. 5 pressure control assembly 42, taken along line 6-6 of FIG. 5, is representatively illustrated. As depicted in FIG. 6, there are two of the pressure sensors 32 in fluid communication with the annulus 46 between the seal elements 34, 36.

Each of the pressure sensors 32 is connected to an electronics package 62 and battery 66. Each of the electronics packages 62 is connected to a corresponding generator 40. In this manner, each set of pressure sensor 32, electronics package 62, battery 66 and generator 40 forms a redundant pressure data transmission system.

Figure 7A:
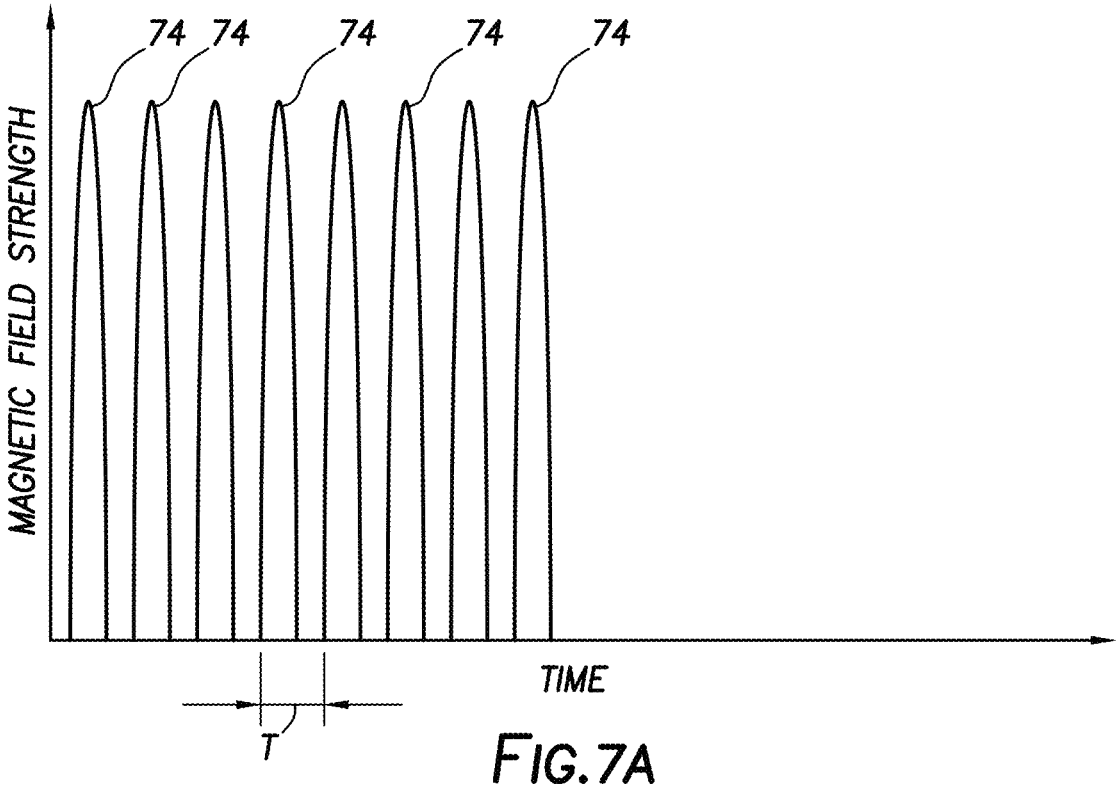
FIGS. 7A & B are representative patterns of magnetic fields detected by a magnetic field detector of the FIG. 3 pressure control assembly.

Referring additionally now to FIGS. 7A & B, example graphs of magnetic field strength versus time for magnetic signals detected by the detector 38 of the FIG. 3 pressure control assembly 42 are representatively illustrated. In an example described above, there are eight of the generators 40 grouped together in a portion of a circumference of the inner barrel 58. Thus, any magnetic signals transmitted by the generators 40 will be received by the detector 38 when that portion of the circumference of the inner barrel 58 is proximate the detector.

In the FIG. 7A graph, a magnetic field is produced by each of the generators 40, and so there are eight magnetic signals 74 detected by the detector 38 in one rotation of the inner barrel 58. The shapes of the magnetic signals 74 will vary depending on, for example, the manner of producing the corresponding magnetic field, how the corresponding generator 40 is activated (e.g., square wave, sine wave, etc.) and other factors.

The magnetic signals 74 together form a pattern of binary values. In this case, if the presence of a magnetic field 74 represents a binary value of "1," then the FIG. 7A pattern corresponds to an eight bit binary number "11111111."

Figure 7B:
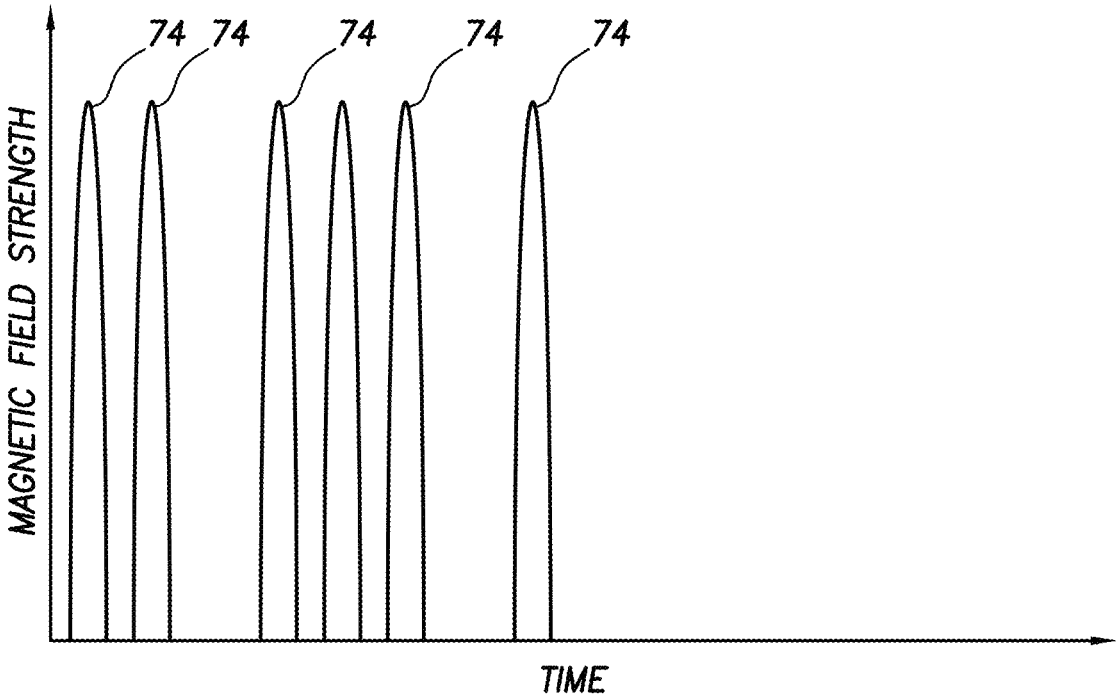

In the FIG. 7B example, a few of the generators 40 are not producing a magnetic field when they pass by the detector 38. Thus, only six magnetic signals 74 are detected by the detector 38 in a rotation of the inner barrel 58. The magnetic signals form a pattern corresponding to an eight bit binary number "11011101." The lack of a magnetic signal detected by the detector 38 represents a binary value of "0."

Thus, it will be appreciated that, by activating different ones of the generators 40, corresponding different numerical values can be represented by the pattern of magnetic signals 74 received by the detector 38. The magnetic signals 74 can indicate the outputs of the pressure sensor 32 and/or the accelerometer 72. Additional generators 40, unevenly spaced, can be used to indicate a beginning and an end of the readable intervals.

As depicted in FIG. 7A, there is a certain time interval T between two adjacent magnetic signals 74. A circumferential or angular spacing between the generators 40 corresponding to the adjacent magnetic signals 74 is known. Therefore, if the time interval T is measured (for example, using the electronics package 64), the rotational or angular velocity of the inner barrel 58 can be readily calculated. This method may be used to determine the rotational or angular velocity of the inner barrel 58 in addition, or as an alternative, to use of the accelerometer 72.

It may now be fully appreciated that the above disclosure provides significant advancements to the art of monitoring operation of a rotating control device. In examples described above, a pressure sensor 32 can output pressure measurements that are communicated to a remote location using magnetic induction. Magnetic field generators 40 can be arranged to produce selected patterns of magnetic signals 74, which are detected by a detector 38 in or on an outer housing 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of monitoring operation of a rotating control device, the method comprising:

securing a magnetic field detector to an outer housing configured to releasably receive the rotating control device therein;

installing the rotating control device in the outer housing, the rotating control device comprising a rotatable inner barrel, a pressure sensor and multiple magnetic field generators; and transmitting signals indicative of outputs of the pressure sensor from the magnetic field generators to the magnetic field detector.

2. The method of claim 1, further comprising rotating the magnetic field generators with the inner barrel relative to the outer housing.

3. The method of claim 2, in which the transmitting comprises activating a selected portion of the magnetic field generators, the selected portion being indicative of the outputs of the pressure sensor.

4. The method of claim 3, in which the selected portion of the magnetic field generators forms a pattern of magnetic fields detected by the magnetic field detector, and in which the pattern of magnetic fields comprises the signals.

5. The method of claim 4, in which the pattern comprises a binary pattern, and the magnetic fields correspond to bits of the binary pattern.

6. The method of claim 4, in which the pattern of magnet fields corresponds to a spacing of the magnetic field generators on the inner barrel.

7. The method of claim 1, in which the rotating control device further comprises an accelerometer, and the transmitting further comprises transmitting signals indicative of outputs of the accelerometer from the magnetic field generators to the magnetic field detector.

* * * * *